US008549773B2

(12) United States Patent
Nakatsuka

(10) Patent No.: US 8,549,773 B2
(45) Date of Patent: Oct. 8, 2013

(54) RUNNING SHOE

(76) Inventor: Tatsuya Nakatsuka, Nagano (JP)

( * ) Notice: Subject to any disclaimer, the term of this patent is extended or adjusted under 35 U.S.C. 154(b) by 625 days.

(21) Appl. No.: 12/832,592

(22) Filed: Jul. 8, 2010

(65) Prior Publication Data

US 2010/0269368 A1 Oct. 28, 2010

(51) Int. Cl.
*A43B 13/28* (2006.01)

(52) U.S. Cl.
USPC ..... 36/27

(58) Field of Classification Search
USPC ..... 36/27, 7.8, 28, 38
See application file for complete search history.

(56) References Cited

U.S. PATENT DOCUMENTS 898,084 A * 9/1908 Backermann ..... 36/7.8
2,172,000 A * 9/1939 Wenker ..... 482/77
4,534,124 A * 8/1985 Schnell ..... 36/114
5,367,790 A * 11/1994 Gamow et al. ..... 36/27
5,435,079 A * 7/1995 Gallegos ..... 36/38
6,684,531 B2 * 2/2004 Rennex ..... 36/27

FOREIGN PATENT DOCUMENTS

JP 10-262706 A 10/1998
JP 3070522 U 8/2000
JP 2001-112505 A 4/2001
JP 3377211 B2 2/2003

* cited by examiner

*Primary Examiner* — Ted Kavanaugh
(74) *Attorney, Agent, or Firm* — Birch, Stewart, Kolasch & Birch, LLP

(57) ABSTRACT

A running shoe stores the shock during landing as energy and releases the stored energy when kicking off the toe portion, thereby making running and walking more efficient. The running shoe includes a shoe main body 10 into which the foot is inserted and a plate spring 5 that is large enough to cover an entire length of the shoe main body 10, is attached to a lower portion of the shoe main body 10, and is closed at a heel end portion thereof. The plate spring 5 is attached to a lower surface of the shoe main body 10 at only a toe end-side of the shoe main body 10.

2 Claims, 3 Drawing Sheets

RUNNING SHOE

CROSS-REFERENCE TO RELATED APPLICATIONS

This application is based upon Japanese Patent Application 2009-030428 filed on Jan. 19, 2009, the entire contents of which are incorporated herein by reference.

FIELD

The present invention relates to a running shoe that converts the impact of landing into propulsion during the kick phase.

BACKGROUND

Conventional running shoes use a mid sole composed of a shock absorbing material that provides extensive cushioning to disperse and alleviate the impact during landing.

However during running, the force applied to the heel is said to be at least three times the bodyweight of the runner. Conventional running shoes have not been able to efficiently convert the impact during landing into energy during the kick phase. Designers have therefore faced the technical problem of how to store the impact during landing as energy and release such energy to the forefoot during the kick phase to make running and walking more efficient.

On the other hand, Japanese Patent 3,377,211 discloses a sports shoe where a hollow is formed at the heel and coil springs are disposed inside the hollow. This sports shoe can absorb the impact and the energy of the impact used to supplement a force that lifts the foot.

Japanese Utility Model 3,070,522 discloses a sports shoe that has a pedal at the toe end of the shoe main body and has a plate spring and another spring provided below the pedal. With this sport shoe, the runner is capable of a high spring due to the repulsive force of the springs.

Also, Japanese Laid-Open Patent Publication No. H10-262706 discloses a shoe that has a plate spring and a coil spring provided at a heel part inside the shoe. According to this shoe, it is possible to use the force of the springs to supplement a force that lifts the heel.

In addition, Japanese Laid-Open Patent Publication No. 2001-112505 discloses a construction for attaching a plate spring to the toe part of a shoe. According to this construction, energy stored by compression of the spring is used to supplement a force that lifts the foot.

SUMMARY

The publications mentioned above merely disclose constructions where a plate spring and/or coil spring is provided at part of a shoe, such as at the heel or at the toe, and therefore it has not been possible to convert the impact received by the heel during running and walking to energy when kicking at the toe. That is, even though it is possible with the constructions disclosed in the publications mentioned above to supplement lift of the heel or the toes, it is not possible to achieve efficient running and walking using the entire foot.

For example, even if a spring is provided at the heel, humans do not walk or run by landing on the heel and then kicking off the heel, which means that it is not possible to achieve efficient running and walking using the entire foot.

In the same way, even if a spring is provided at the toes and it is possible to use the force of the spring during the kick phase, if the runner lands on his/her heel, it will not be possible to directly transfer the energy during landing to a spring located at the toes. This means that it is still not possible to achieve efficient running and walking using the entire foot.

The present invention was conceived to solve the problem described above and it is an object of the present invention to provide a running shoe that makes running and walking efficient.

A running shoe according to the present invention includes: a shoe main body into which a foot is inserted; and a plate spring that is large enough to cover an entire length of the shoe main body, is attached to a lower portion of the shoe main body, and is closed at a heel end portion thereof, wherein the plate spring is attached to a lower surface of the shoe main body at only a toe end-side of the shoe main body.

When an external force that attempts to narrow the gap is applied, the plate spring will have a restoring force that attempts to restore the original gap. This means that during landing, the plate spring will act as a cushion that absorbs the impact and will also transmit the energy applied to the heel to the toe portion due to the gap of the plate spring narrowing. After this, energy is further stored during the transfer of weight, and by releasing the stored energy when kicking at the toe portion, it is possible to generate a powerful kick.

Also, since the plate spring is attached to the lower surface of the shoe main body at only the toe end of the shoe main body, during the kick phase, the heel part of the shoe main body will become separated from the plate spring, which means it is possible to achieve a smooth kick with no loss in the curvature of the shoe. That is, although the shoes disclosed by the publications mentioned above will assist a runner whose feet have significantly weakened, such shoes give no consideration to curvature as does the running shoe of the present application, and therefore it was not possible to actually run in such shoes.

An energizing member that energizes the gap so as to widen may be provided at a toe end of the gap in the plate spring.

By using this energizing member, it is possible to supplement the cushioning and restoring force of the plate spring and also to improve durability. Also, if the energizing force of the energizing member is set large, it becomes possible to reduce the springiness of the closed-end portion of the plate spring. In this case, as one example, the plate spring may be constructed of a stepping plate that is disposed below the shoe main body and a ground-side plate that is disposed at a gap from the stepping plate, with the stepping plate and the ground-side plate being connected by a connecting member such as a hinge at the heel end portion.

Also, the running shoe may also include a connecting member that is provided at a toe end of the gap between the stepping plate and the ground-side plate and connects the stepping plate and the ground-side plate so as to prevent the stepping plate and the ground-side plate from becoming horizontally displaced.

By providing the connecting member, it is possible to suppress movement in the left-right direction and prevent horizontal wobbling and resonance of the plate spring, thereby increasing stability. It is also possible to provide the energizing member described above with the same functions as this type of connecting member.

In addition, the plate spring may be formed so as to be curved in an up-down direction in accordance with the shape of the sole of a human foot.

With the running shoe according to the present invention, it is possible to store the impact during landing as energy and release the stored energy when kicking at the toe, thereby reducing fatigue of the foot and making running and walking more efficient.

DESCRIPTION OF EMBODIMENT(S)

Figure 1:
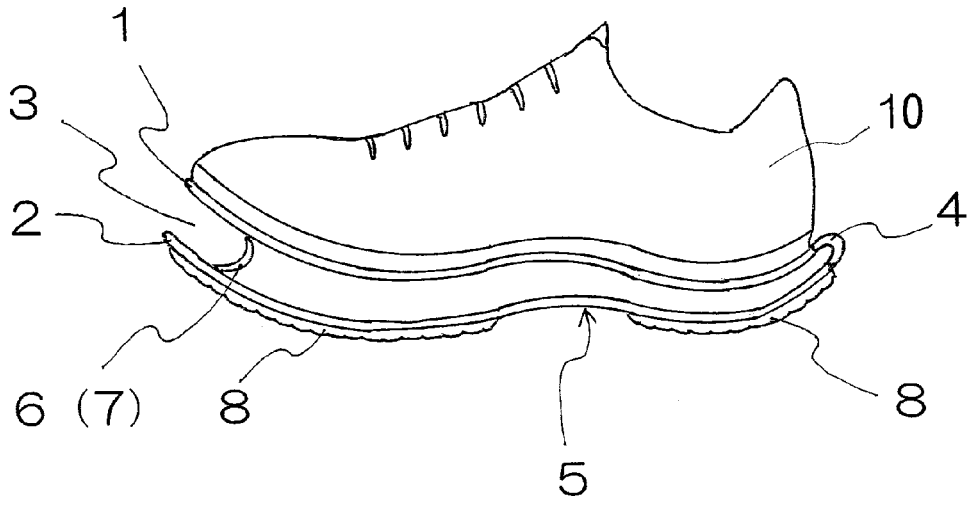
FIG. 1 is a side view of a running shoe according to the present invention.

FIG. 1 is a side view of a running shoe according to the present invention. The running shoe includes a shoe main body 10 constructed so that the foot can be inserted and a plate spring 5 formed below the shoe main body 10 so as to extend along the entire length of the shoe main body 10. The plate spring 5 is provided in place of a conventional midsole, and functions so as to absorb impact during landing and to release energy during the kick phase.

The plate spring 5 includes a hard stepping plate 1 that extends from a heel portion to a toe portion of the plate spring 5 and a hard ground-side plate 2 that also extends from the heel portion to the toe portion, with respective heel portions of the stepping plate 1 and the ground-side plate 2 being connected by a joint portion 4. The joint portion 4 may be a member that acts as a spring with an energizing force that energizes the connected stepping plate 1 and the ground-side plate 2 in a direction where the stepping plate 1 and the ground-side plate 2 move apart.

The plate spring 5 is attached to a lower surface of the shoe main body 10 only at a position on the toe side of a halfway point along the length direction of the plate spring 5. Accordingly, the stepping plate 1 of the plate spring 5 moves away from the shoe main body 10 at the heel during the kick phase. By using this construction, it is possible to prevent a loss in curvature of the shoe main body 10 during the kick.

Reinforced plastic, carbon fiber, or the like that is resistant to twisting, resistant to flexing, and lightweight are suited to use as the material of the plate spring 5.

To achieve a smooth transfer of weight between landing on the heel and kicking off the toe, the form of the hard ground-side plate 2 should not be flat with respect to the ground but instead should be formed so as to be upwardly convex in a central part thereof and therefore curved when seen from the side. By having the central part curved into a convex, it is possible to make movement of the center of gravity more rapid. That is, since the convex part will contact a position that corresponds to the plantar arch of the sole of the human foot, it is possible to rapidly move the center of gravity during movement of the center of gravity to the toe after landing on the heel.

Note that in the same way as the ground-side plate 2, the hard stepping plate 1 may be formed so as to be upwardly convex in a central part thereof and therefore curved when seen from the side.

By also forming the ground-side plate 2 in this shape, it is possible to prevent the central part of the foot from sinking and thereby increase forward propulsion.

The joint portion 4 may be integrally molded of the same material as the hard stepping plate 1 and the hard ground-side plate 2. In such case, a bent-over part of the stepping plate 1 and the ground-side plate 2 that are integrally constructed functions as the joint portion 4.

The joint portion 4 of the present embodiment is provided so as to protrude outward beyond the end of the shoe main body 10. By disposing the joint portion 4 in this way outside the shoe main body 10, it becomes possible to effectively use the energy stored at the heel during landing.

Also, when the joint portion 4 on its own provides insufficient cushioning and joint strength as a plate spring, an energizing member 6 may be provided in a gap between the hard stepping plate 1 and the hard ground-side plate 2 that construct the plate spring 5 so as to energize the gap in a direction where the gap widens. A spring or the like can be used as the energizing member 6.

By disposing the energizing member 6 in the gap of the plate spring 5, it is possible to improve the action of the repulsive force of the plate spring 5 and to also improve durability. If the energizing force of the energizing member 6 is set sufficiently large, it is possible to reduce the springiness (energizing force) of the joint portion 4. For example, when the energizing force of the energizing member 6 is set large in this way, it is possible to use a member with hardly any springiness, like a hinge, as the joint portion 4.

Also, a connecting member 7 that permits movement in the up-down direction and suppresses movement in the left-right direction may be provided in the gap between the hard stepping plate 1 and the hard ground-side plate 2 that construct the plate spring 5. The connecting member 7 can be composed of a material such as rubber or sponge.

By providing the connecting member 7 in the gap of the plate spring 5, it is possible to prevent horizontal wobbling and resonance of the plate spring 5, thereby increasing stability. By using rubber or the like that has high elasticity as the connecting member 7, it is also possible to provide the connecting member 7 with the functions of the energizing member 6.

An elastic body such as rubber formed with protrusions is provided on a ground-contacting surface of the hard ground-side plate 2 as an outsole 8. By doing so, it is possible to increase grip on the ground and to efficiently transfer energy to the ground during the kick phase.

Figure 2:
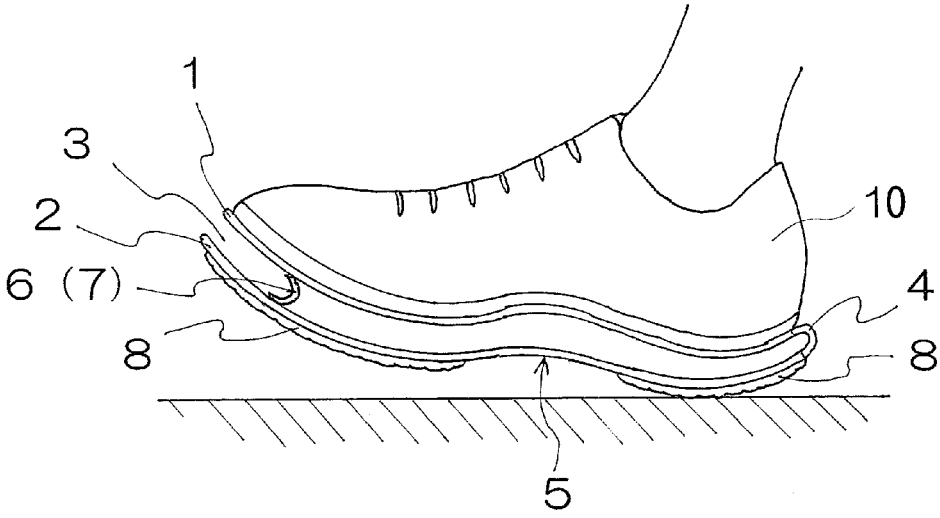
FIG. 2 is a side view of the running shoe according to the present invention during landing.

FIG. 2 is a side view of the running shoe during landing. During landing, due to the gap 3 between the hard stepping plate 1 and the hard ground-side plate 2 narrowing, the plate spring 5 acts as a cushion that absorbs the impact and also transmits the energy applied to the heel to the toe portion of the plate spring 5.

Figure 3:
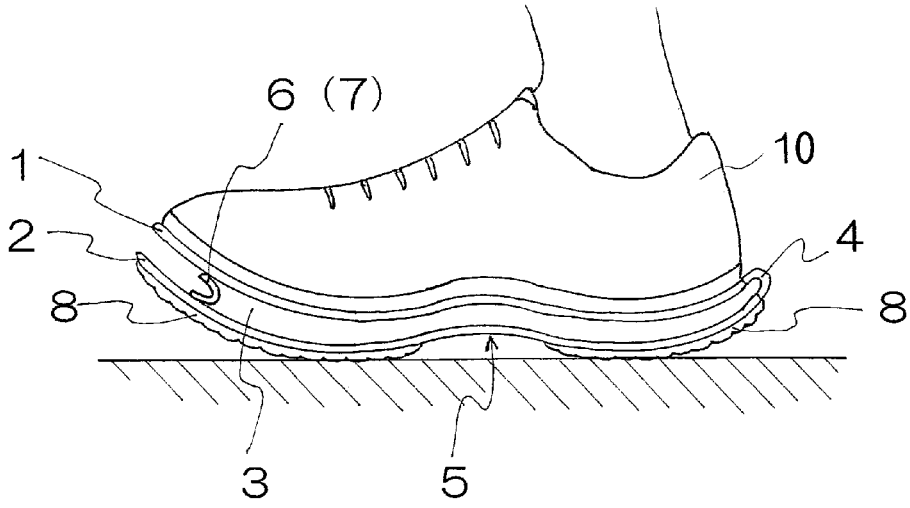
FIG. 3 is a side view of the running shoe according to the present invention during weight transfer.

FIG. 3 is a side view of the running shoe during weight transfer. As the body weight moves, energy is stored due to the gap 3 narrowing further.

Figure 4:
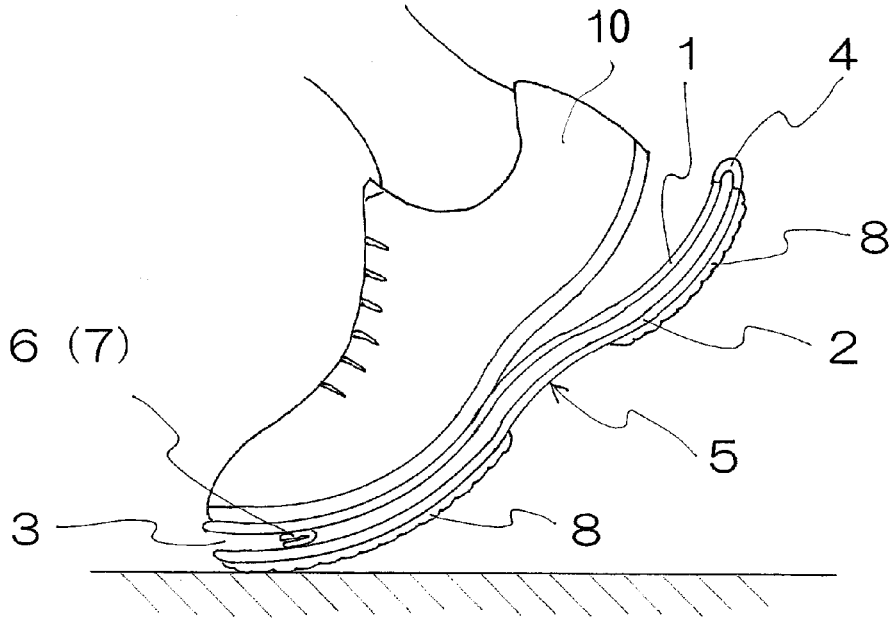
FIG. 4 is a side view of the running shoe according to the present invention during the kick phase.

FIG. 4 is a side view of the running shoe during the kick phase. During the kick phase, since the heel of the shoe main body 10 becomes separated from the stepping plate 1, it is possible to achieve a smooth kick with no loss in the curvature of the shoe. By releasing the energy stored due to the gap 3 narrowing via the restoring force of the plate spring 5, it is possible to generate a powerful kick.

Figure 5:
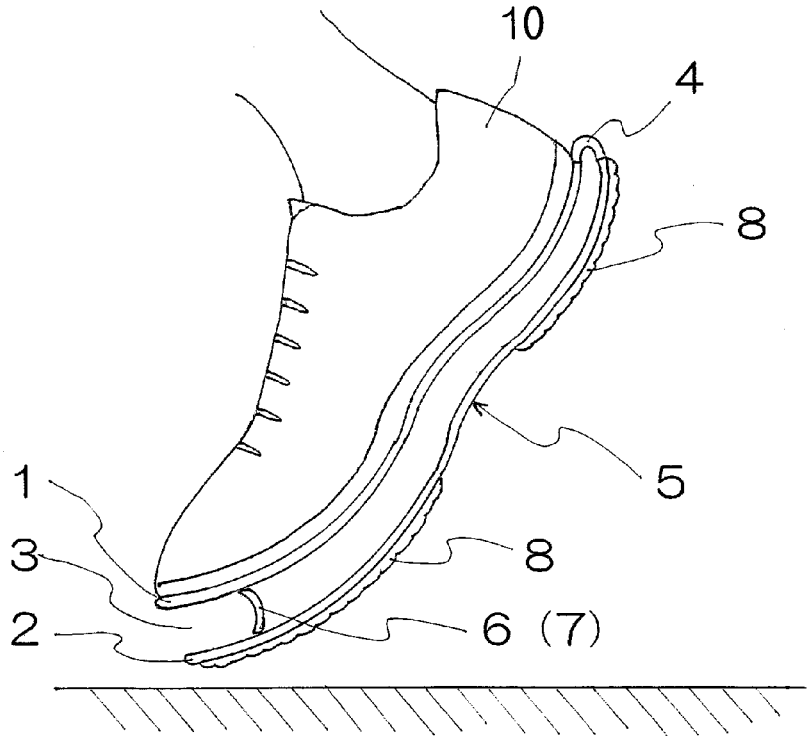
FIG. 5 is a side view of the running shoe according to the present invention after the kick phase.

FIG. 5 is a side view of the running shoe after the kick phase. After the kick phase, the gap 3 is restored due to the restoring force of the plate spring 5 and becomes ready for the next landing.

What is claimed is:

1. A running shoe comprising:

a shoe main body into which a foot is inserted;

a stepping plate that is large enough to cover an entire length of the shoe main body, being attached to only a toe-end side of a lower portion of the shoe main body;

a ground-side plate; and a joint portion connecting heel portions of the stepping plate and the ground-side plate, the joint portions acting as a spring with an energizing force that energizes the connected stepping plate and the ground-side plate in a direction where the stepping plate and the ground-side plate move apart, wherein the stepping plate and the ground-side plate that are connected by the joint portion construct a plate spring, a toe-end side and a heel side of the ground-side plate are made convex toward the ground, and the joint portion is protruded outward beyond a heel-side end of the shoe main body.

2. The running shoe according to claim 1, further comprising an energizing member being provided in a toe-end side of a gap between the stepping plate and the ground-side plate that construct the plate spring so as to energize the gap in a direction where the gap widens, and so as to prevent left-right displacement of the stepping plate and the ground-side plate capable of moving in a up-down direction.

* * * * *